US011333471B2

(12) United States Patent
Maricaille

(10) Patent No.: US 11,333,471 B2
(45) Date of Patent: May 17, 2022

(54) BIODEGRADABLE WADDING CUP FOR A SHOTGUN CARTRIDGE

(71) Applicant: SHOOT HUNTING OUTDOOR, Briatexte (FR)

(72) Inventor: Patrick Maricaille, Briatexte (FR)

(73) Assignee: SHOOT HUNTING OUTDOOR, Briatexte (FR)

( * ) Notice: Subject to any disclaimer, the term of this patent is extended or adjusted under 35 U.S.C. 154(b) by 0 days.

(21) Appl. No.: 17/257,397

(22) PCT Filed: Jul. 3, 2019

(86) PCT No.: PCT/IB2019/055682
§ 371 (c)(1),
(2) Date: Dec. 31, 2020

(87) PCT Pub. No.: WO2020/008390
PCT Pub. Date: Jan. 9, 2020

(65) Prior Publication Data

US 2021/0270586 A1 Sep. 2, 2021

(30) Foreign Application Priority Data

Jul. 5, 2018 (FR) ..... 18/70802

(51) Int. Cl.
*F42B 7/08* (2006.01)

(52) U.S. Cl.
CPC ..... *F42B 7/08* (2013.01)

(58) Field of Classification Search
CPC ..... F42B 7/08; F42B 7/00
(Continued)

(56) References Cited

U.S. PATENT DOCUMENTS 1,908,314 A * 5/1933 Brownsdon ..... F42B 7/08 102/532
1,917,118 A * 7/1933 Hislop ..... F42B 7/08 102/461

(Continued)

FOREIGN PATENT DOCUMENTS

DE 4016826 A1 * 11/1991 ..... F42B 7/08
FR 361.961 1/1907

(Continued)

OTHER PUBLICATIONS

International Search Report for PCT/IB2019/055682 dated Oct. 28, 2019, 3 pages.

(Continued)

*Primary Examiner* — John Cooper
(74) *Attorney, Agent, or Firm* — Nixon & Vanderhye

(57) ABSTRACT

Disclosed is an intermediate part forming a wadding cup to be placed in the case of a cartridge for separating the explosive charge and the shot. It includes a cylindrical sleeve of outer diameter suitable for being inserted slidingly into the case, the sleeve having a front portion the end of which is open, suitable for containing the shot, and a rear portion including a cylindrical wad flush with the end of the rear portion, the intermediate part being formed of at least 95% by weight of biodegradable or decomposable materials, such as cardboard and cork. Also disclosed is a biodegradable cartridge with cup and wadding, complying with environmental rules.

20 Claims, 3 Drawing Sheets

(58) Field of Classification Search
USPC ..... 102/451, 449, 450, 453, 461
See application file for complete search history.

(56) References Cited

U.S. PATENT DOCUMENTS

| | | | | | |
|---|---|---|---|---|---|
| 2,759,420 | A * | 8/1956 | Schultz | F42B 7/04 | 102/408 |
| 3,022,731 | A | 2/1962 | Yeomans, Jr. | | |
| 3,022,734 | A | 2/1962 | Kidder | | |
| 3,270,669 | A * | 9/1966 | Atkins | F42B 7/04 | 102/451 |
| 3,672,301 | A * | 6/1972 | Abbott | F42B 8/04 | 102/530 |
| 3,906,859 | A * | 9/1975 | Smith | F42B 5/025 | 102/444 |
| 4,103,621 | A * | 8/1978 | Fackler | F42B 7/08 | 102/453 |
| 5,235,915 | A * | 8/1993 | Stevens | C06B 33/00 | 102/439 |
| 5,263,417 | A * | 11/1993 | Godfrey-Phillips | F42B 7/08 | 102/453 |
| 5,413,050 | A * | 5/1995 | Maki | F42B 7/04 | 102/449 |
| 5,549,048 | A * | 8/1996 | Godfrey-Phillips | F42B 5/30 | 102/466 |
| 5,859,090 | A * | 1/1999 | Shahid | F42B 7/06 | 523/124 |
| 7,610,857 | B1 * | 11/2009 | Dunnam | F42B 12/382 | 102/458 |
| 10,684,104 | B2 * | 6/2020 | Lopez-Pozas Lanuza | C08K 5/0033 | |
| 2001/0042486 | A1 * | 11/2001 | Dales | F42B 7/08 | 102/449 |
| 2004/0099172 | A1 * | 5/2004 | Schikora | F42B 7/08 | 102/450 |
| 2008/0223245 | A1 * | 9/2008 | Stevens | F42B 7/08 | 102/453 |
| 2014/0366765 | A1 * | 12/2014 | Havens | F42B 7/02 | 102/532 |
| 2016/0010963 | A1 * | 1/2016 | Moreno | F42B 7/08 | 102/532 |
| 2016/0334197 | A1 * | 11/2016 | Pedretti | F42B 7/08 | |
| 2017/0010079 | A1 * | 1/2017 | Maricaille | F42B 12/74 | |
| 2018/0128583 | A1 * | 5/2018 | Lopez-Pozas Lanuza | F42B 7/06 | |
| 2018/0274890 | A1 * | 9/2018 | Havens | C08L 67/02 | |
| 2020/0355476 | A1 * | 11/2020 | McIntosh | F42B 7/046 | |
| 2021/0270586 | A1 * | 9/2021 | Maricaille | F42B 7/08 | |

FOREIGN PATENT DOCUMENTS

| | | | | | |
|---|---|---|---|---|---|
| FR | 1.485.731 | | 6/1967 | | |
| FR | 2 741 627 | | 5/1997 | | |
| GB | 2367606 | A * | 4/2002 | F42B 7/08 | |
| GB | 2586909 | A * | 3/2021 | F42B 7/08 | |
| JP | 2000258098 | A * | 9/2000 | C06B 21/00 | |
| WO | 2014/201278 | | 12/2014 | | |
| WO | 2016/174276 | A1 | 11/2016 | | |
| WO | WO-2016174276 | A1 * | 11/2016 | F42B 7/08 | |
| WO | WO-2018175471 | A1 * | 9/2018 | F42B 33/12 | |
| WO | WO-2018175492 | A1 * | 9/2018 | C08L 67/04 | |
| WO | WO-2020079088 | A1 * | 4/2020 | F42B 7/08 | |
| WO | WO-2021044139 | A1 * | 3/2021 | F42B 7/08 | |

OTHER PUBLICATIONS

Written Opinion of the ISA for PCT/IB2019/055682 dated Oct. 28, 2019, 5 pages.

* cited by examiner

BIODEGRADABLE WADDING CUP FOR A SHOTGUN CARTRIDGE

BACKGROUND OF THE INVENTION

Field of the Invention

The present invention lies in the field of ammunition used for firearms, and it relates more particularly to the field of cartridges that have multiple projectiles and that are used for shooting-type hunting, or for recreational shooting.

It relates to a part designed to be placed in a cartridge for the purpose of separating the explosive charge from the shot, the part comprising a wad inserted in a sleeve, the wad and the sleeve together forming a wadding cup that is made of environmentally-friendly materials.

Description of the Related Art

It is known that shotgun cartridges are formed by a cylindrical case that is reinforced at its base by a metal base or "head" that is generally made of brass. Nowadays, the case, which used to be made of cardboard, is more often formed from a tube made of a plastics material. Cartridges contain firstly an explosive charge (i.e. powder) that is in contact with a primer, and secondly a set of projectiles in the form of shot that is made up of balls or pellets and that continues to be referred to as "lead" or "lead shot" despite that fact that less pollutant materials are now used to make it. The explosive charge and the shot are separated from each other by a wedging device known as wadding.

The wadding plays an essential part because it transmits to the shot the energy induced by the thrust from the gases generated by combustion of the powder, it being necessary for the thrust to be uniform and without energy loss in order to be effective. In order to play its part properly, the wadding must have various qualities. Above all, it must provide sealing by preventing the burning-hot gases under pressure from passing through so as to prevent the gases from dispersing while the shot is travelling through the barrel of the weapon as soon as it has left the case. This limits the resulting energy loss and also prevents any melting of balls of shot into fused clusters, the danger of which is high in view of the distance the shot travels in the barrel. Furthermore, infiltration of combustion gases might give rise to disturbances in the spray of shot, i.e. in the pattern of the string of shot. The wadding should be compressible and elastic in order to damp or absorb the shock produced by the sudden inflammation of the powder. This avoids crushing the shot (so as to transmit the full force of the explosion to the shot without deforming it), such crushing being detrimental to the uniformity of the spray of shot. The wadding also makes it possible to clean the bore of the barrel each time the shotgun is fired and guarantees uniform thrust on the base of the set of projectiles.

Traditionally, greased wadding was used that was made up of a layer of felt or cork, that was inserted into a cardboard case above the powder and that was then covered with shot. The wadding was greased so as to provide sealing and so as to limit the friction forces against the barrel. Two protective wafers that were, for example, made of cardboard, prevented the powder and the shot from coming into direct contact with the greased wadding.

In modern cartridges, the case is made of a plastics material while the greased wadding has been replaced with a wadding cup or a wadding skirt that is also made of a plastics material. The end-wall of the cup forms a transverse element separating the shot from the powder. The skirt extends corolla-like towards the front of the case and contains the shot. When the shotgun is fired, the wadding is expelled at the same time as the shot, thereby preventing the balls of shot from being deformed due to friction in the bore of the barrel, and, in doing so, protecting the barrel from wear and from shot deposition. Most wadding cups also have a rear skirt serving to close off the compartment containing the powder and also acting as a damper or shock absorber.

Such wadding makes it possible to keep the spray of shot together for longer and therefore requires more accurate shooting. Such wadding is used in most cartridges that are currently sold for shotguns (and for other smoothbore guns). Hundreds of millions of cartridges are fired every year in the various countries of the world. While it is easy to retrieve cartridge cases that fall to the ground in the vicinity of the shooter after a shotgun has been fired, the same does not apply to the wadding that is expelled over long distances, and often to places that are difficult to access. This results in so many pieces of synthetic material that do not rot being abandoned in the natural environment and having numerous and lasting harmful and polluting effects, not only for forests, but also for meadows, and for wetlands, ponds, lakes, and rivers. Such abandoned waste goes into the cycles of the ecosystems. It is regularly found in stomachs of animals all over the world, which shows that it is present in the food chain and therefore finds its way onto our plates.

In order to remedy the problem of natural environments being polluted by spent and lost cartridge elements, it has been proposed to make cartridges of materials that are degradable under the action of light, of rain, or of microorganisms. Research has been conducted to develop biodegradable plastics materials that have the required mechanical properties. For example, Document FR 2 741 627 proposes degradable thermoplastic compositions containing: a hydrocarbon-based binder provided with an ester function; starch; and titanium oxide acting as an oxidizing agent by exposure to light. Those compositions do not make it possible to eliminate the pollution lost in dark places such as in undergrowth, in tall grass, in ponds, etc. Document WO 2014/201278 discloses ammunition provided with a wadding cup made of polyhydroxyalkanoate or "PHA" (a biodegradable polyester) having specific density of greater than one, and suitable for being degraded by forming small particles that are assumed to be benign, provided that they stay in water. With that wadding cup too, there is no certainty that the spent and lost wadding will find itself in conditions suitable for eliminating it. Furthermore, the use of petroleum derivatives for making such cartridges merely shifts the environmental pollution problems. Another response consists in using biodegradable thermoplastic polymers of vegetable origin as raw materials. For example, the cartridges described in Patent Application No. WO 2016/174276 comprise polymers based on polylactic acid or on polycaprolactone. Those materials are known for their medical applications, in particular in osteoplasty, and they are degraded within several months. However, they are too costly for the target use herein.

SUMMARY OF THE INVENTION

An object of the present invention is to mitigate the above-mentioned drawbacks, by providing a biodegradable part that acts as wadding for cartridges having multiple projectiles. Another object of the invention is to propose a part made of materials of natural origin, and not using synthetic raw materials. Another object of the invention is to provide such an intermediate part that has mechanical and ballistic characteristics that are at least as high-performance as those of cartridges equipped with conventional wadding skirts. More specifically, the aim is to replace conventional wadding cups with a part that is degraded in the natural environment under the effect of ambient humidity or moisture, within three or four weeks, or even within a few days, without its pre-use functionality features being adversely affected. Such a part should be simple to manufacture and inexpensive. Another aspect of the invention relates to providing cartridges equipped with such an intermediate part, such cartridges being designed for shooting medium-size game, clay pigeon shooting, or other competitive and recreational activities in which the weapon has a smoothbore barrel.

The above objects are achieved by the present invention in which a cylindrical sleeve and a wad that are made of biodegradable materials are associated with each other to form an intermediate part that replaces a wadding cup in a shotgun cartridge or in a similar cartridge.

More specifically, the invention provides an intermediate part designed to be placed in the case of a cartridge so as to separate the explosive charge from the shot, said intermediate part comprising a cylindrical sleeve of outside diameter adapted to being slidably inserted into the case of the cartridge, said sleeve having a front portion that has an open end, and that is suitable for containing said shot, and a rear portion that contains a cylindrical wad having its rear face flush with the end of the rear portion of the sleeve, at least 95% by weight of said intermediate part being constituted by biodegradable or decomposable materials.

In the following description, the portions that are situated in the "front" are the portions that are to be placed in the cartridge so that they face towards the muzzle of the barrel of the weapon, while the portions referred to as "rear" portions are those that are to be placed towards the breech end of the barrel. Thus, regarding the intermediate part, its rear portion is in the vicinity of the explosive charge, its front portion being on the shot side. The terms "shot" and "lead" are used indiscriminately to designate the particles of the offensive charge or load, even though they are usually lead-free.

The intermediate part of the invention comprises a cylindrical sleeve of outside diameter adapted to being slidably inserted into the case of the cartridge. The cylindrical sleeve thus takes the form of a tube in which the core or "bore" is delimited by the inner face. The outer face of the tube is designed to be in contact with the inner face of the case of a cartridge, which, conventionally, is itself cylindrical.

The intermediate part of the invention further comprises a cylindrical wad that is inserted into the sleeve and that closes off the rear portion of the sleeve completely, a base of the cylindrical wad coming flush with the rear end of the sleeve, so that said base of the wad coincides with the end of the sleeve. The wad constitutes a wedging device between the explosive charge and the shot, thereby acting as wadding, in a manner comparable to greased wadding in traditional weapons. However, it differs from such greased wadding in that it is not greased for providing the sealing function. The sleeve acts to hold the wad via its rear portion and to contain the shot in its front portion. The front portion of the sleeve thus constitutes a skirt that imparts to the intermediate part the advantages of the above-mentioned wadding cups. In known manner, the skirt-forming sleeve occupies, across its diameter, the empty space inside the case, with an amount of clearance enabling it to be slidably inserted.

The intermediate part of the invention thus combines the qualities of traditional wadding and those of modern wadding. Furthermore, it offers unrivalled environmental quality insofar as the materials used to manufacture it can be degraded or can decompose naturally for at least 95% of their weight (or, to be more precise, for 95% of their mass). Biodegradability is defined as being the capacity of materials to be transformed and broken down under the action of living organisms into elements that are devoid of any effect that is harmful to the natural environment. Natural decomposition relates to the capability of materials to break up under the effect of climate conditions (water, light, frost, etc.) into fragments of matter devoid of any effect that is harmful for the natural environment. Such "fragments" are particles of size lying in the range less than one millimeter (mm) to a few millimeters, e.g. in the range 0.5 mm to 3 mm. Thus, firstly, the organic matter that constitutes the material can be converted rapidly into carbon dioxide, methane, water, and biomass by action from microorganisms. Secondly, the material can disintegrate, leaving fragments that contain only natural substances, which are present elsewhere in nature, as applies to wood or to animal hair or fur.

It is specified that, in view of the use that is to be made of the intermediate parts of the invention, biodegradability or decomposability is assessed within a range of temperatures that can prevail in temperate regions, i.e. within a range of mean daily temperatures extending from +5° C. to +35° C. A shooter or hunter operating in the countryside of Europe, for example, is likely to encounter such temperatures and can fire cartridges equipped with intermediate parts of the invention without contaminating natural spaces.

In accordance with a preferred characteristic of the intermediate part of the invention, at least 95% by weight of the sleeve is formed by biodegradable materials. Ideally, a material is chosen that is degraded to at least 98%, or indeed entirely, within a few weeks or even within a few days.

Various materials are known for their biodegradability. However, the materials chosen for manufacturing the sleeve must satisfy other constraints, in particular mechanical and ballistic constraints. Surprisingly, it has been found that a manufactured material of vegetable origin such as cardboard could satisfy all of the targeted criteria. The choice of a smooth cardboard having a thickness of approximately in the range half a millimeter to one millimeter makes it possible to obtain the necessary stiffness or rigidity for behaving well during firing, without generating superfluous bulk. Thus, in a preferred embodiment of the intermediate part of the invention, the sleeve is constituted by a cardboard tube of thickness lying in the range 0.4 mm to 1 mm.

In accordance with a preferred characteristic of the intermediate part of the invention, at least 95% of the wad is formed by biodegradable materials, by decomposable natural materials, or by a combination of both types of material. When the chosen materials decompose naturally, the remaining fraction is preferably constituted by biodegradable materials so that the wad does not generate any residual pollution of the surrounding environment. Various materials of vegetable or of animal origin may be suitable for wedging between the powder and the shot.

For example, it is possible to use flax fibers, cotton fibers or other vegetable fibers, or animal fibers such as felts obtained from hair, fur, or wool taken from various animals. It is also possible to use transformed materials such as products based on cellulose (cardboard, paper) or agglomerates such as chipboard, agglomerated cork, or the like. In a preferred embodiment of the invention, the wad comprises one or more materials chosen from: cork, wood fiber, cardboard, and felt.

These materials may be implemented in different manners, on their own or mutually combined. If a single material is used, the wad may be made in a single block of material, cut out from a solid thickness of material. Materials such as felts made by compressing and fulling animal fibers may be cut up into cylindrical segments to the dimensions suitable for being inserted into the sleeve. The result is that they constitute a homogenous block of material in the same way as a block of cork or of wood can do. In order to facilitate cutting up the material, it is thus possible to prepare cylindrical slices (or wafers) of wood, cork, etc. that are of lesser thickness, and then to stack them up to obtain a wad of suitable height. The wad is then formed of superposed slices (optionally bonded together adhesively) made of the same materials or of different materials that can be stacked up in alternation. In this situation, slices of cardboard may also be used, whenever a wad made of a block of cardboard directly having the desired thickness would be too difficult to cut out. Thus, in accordance with the invention, the wad may be formed a block of a single material, or of superposed slices of the same material or of different materials. In a particular embodiment of the invention, the wad may be formed of a block of cork that is cut out using a hollow punch or a cutting die.

The slices may be assembled together on being inserted into the sleeve, inside which they are then held together one against another. They may also be assembled beforehand, by bonding with a natural adhesive substance. The adhesive power of the adhesive that is used may be moderate insofar as it suffices to hold the slices together until they are inserted into the sleeve, which then keeps them together. For example, it is possible to use a biodegradable adhesive based on casein, on starch, or on cellulose.

In another embodiment of the invention, the wad may be formed of one or more agglomerated materials, i.e. of fragments of the chosen material(s) that are amalgamated by a binder representing less than 1% of the total mass.

In a preferred variant of the invention, the wad is formed of amalgamated cork granules. The cork granules result from grinding cork into particles that are of various granule sizes, e.g. in the range 0.5 mm to 3 mm. The binder may be chosen from among numerous known substances, of vegetable or animal origin, such as, for example, vegetable gums, starches, latex, vegetable resins, milk casein, celluloses, or other substances. The binder may also be chosen from among the thermoplastic resins that are commonly used in manufacturing agglomerated cork. Preferably, a biodegradable binder is used that also acts as an adhesive. It should be noted that insofar as the binder generally represents less than 1% of the mass of the agglomerated cork, this point is not critical. The cork granules and the binder are mixed, poured into molds, heated, cooled, and then unmolded. Sheets are thus obtained, from which the wads are cut out using a hollow punch. Such a wad disintegrates rapidly into cork granules by the organic binder being degraded, microorganisms being partial to such organic binders. Subsequent microbiological decomposition of the cork granules does not produce toxic compounds, the only substance released being carbon dioxide. Using cork is all the more virtuous since it makes it possible to use waste from bottle cork manufacturing and to recycle used corks.

The sleeve and the wad are assembled together and kept together to form an intermediate part of the wadding cup type. In accordance with an advantageous characteristic of the present invention, the wad may be held in the sleeve by friction. To achieve this, the wad has a diameter identical to the inside diameter of the sleeve, so that there is no clearance between them. The friction forces considerably limit movement of the wad in the sleeve under the pressure from the discharge. To supplement the fastening, the wad may be held in the sleeve both by friction and by adhesive bonding. If a cork wad and a cardboard sleeve are used, it is recommended that the wad be adhesively bonded to the sleeve. Preferably, a biodegradable adhesive is then used, such as an adhesive based on starch, on cellulose, on casein, or the like.

As indicated above, conventional wadding cups have a rear skirt that serves to close off the compartment containing the powder and that limits the extent to which the gases under pressure pass through between the wadding and the case when the shot is fired. The intermediate part of the invention may also be provided at its rear end with an element reinforcing the sealing. For this purpose, in accordance with a preferred characteristic of the invention, the rear face of the wad is associated with a dish made of a biodegradable material, said dish having an end-wall of diameter identical to the diameter of the sleeve and a circular rim that extends rearwards in alignment with said sleeve. In this way, the dish adjoins the rear of the intermediate part, without penetrating into the sleeve, thereby avoiding the risk of deforming said sleeve. It may be made of any material that has biodegradability close to the biodegradability of the sleeve, e.g. made of cardboard. In this situation, it may conveniently be manufactured from a wafer of cardboard of thickness lying in the range 0.3 mm to 1 mm, stamped so as to push in a disk constituting the end-wall, the peripheral portion of the wafer being raised to form the rim. The dish is then fastened to the accessible base of the wad that is flush with the end of the sleeve, so that the rim extends rearwards.

The end-wall of the dish may be fastened directly to the wad by an adhesive that is preferably biodegradable, as described above. In a variant embodiment, a rigid disk may be interposed between the end-wall of the dish and the rear face of the wad.

The rigid disk has a diameter equal to the diameter of the sleeve as measured at its outer face, so that the periphery of the disk bears against the rear end of the circular sleeve. This arrangement offers two main advantages. Firstly, it facilitates assembly and centering of the disk to and at the rear of the sleeve. Secondly, it prevents the risk of the dish being pushed into the sleeve at the moment at which the propulsion takes place. Although this risk is quite low and is not dangerous, it is a source of disappointment for the shooter. The disk is made of a rigid material of small thickness, e.g. thickness lying in the range 0.3 mm to 1 mm, and that is preferably biodegradable. For example, it is possible to use the same cardboard as for the dish. Its rigidity or stiffness, which is in relation to its function, is thus comparable to that of the cardboard (and not comparable with a floppy material of the paper type). The disk may be adhesively bonded between the dish and the wad, using an adhesive as described above. Thus, in a particular embodiment of the invention, the assembly associating the dish and the rear face of the wad comprises a rigid separator disk having its periphery bearing against the end of the rear portion of the sleeve.

In a preferred embodiment of the invention, said dish and the separator disk, when such a disk is present, are made of cardboard of thickness lying in the range 0.3 mm to 1 mm, and are fastened to the rear face of the wad by adhesive bonding. During manufacture of the cartridge, the powder is pushed into the case by exerting a certain pressure, thereby crushing the rim. The rim then flares radially into a frusto-conical shape bearing markedly against the wall of the case and acting as a closing-off piece. This then avoids loss of pressure when the shot is fired, and uniform thrust is obtained.

Furthermore, the sleeve may be provided with slits that extend longitudinally from the front end of the sleeve towards the rear portion of the sleeve. The slits, of which there are generally in the range two to four, are advantageously distributed in equidistant manner. They may extend to the wad (which is itself more or less long depending on the specific characteristics of the ammunition) without, in principle, going beyond one half of said sleeve. This arrangement enables the skirt to open out corolla-like and gives shape to the spray of shot when the shotgun is fired.

The slits may be cut fully or else, in an advantageous embodiment of the invention, they may be in the form of partial pre-cuts, e.g. in the form of dotted lines of perforations or in the form of non-through grooves scored into the inner face of the sleeve, so as to reduce its thickness. This thus weakens the wall of the sleeve along the pre-cut lines, which tear under the pressure when a shot is fired, the skirt then opening out corolla-like to give shape to the spray of shot.

That is why, in accordance with an advantageous characteristic of the invention, the sleeve is provided with slits that are equidistant and that extend longitudinally from the front end towards the rear portion of said sleeve, said slits being cut fully or being in the form of partial pre-cuts.

It appears finally that an appropriate choice of materials makes it possible to manufacture an intermediate part in which more than 98% by weight of it, and indeed more than 99% by weight of it, is constituted by biodegradable or decomposable materials. This applies, for example, if a cardboard sleeve and a cardboard dish are used, with a wad made of agglomerated cork. Any manufacturing additives, such as the adhesive and the binder, have little impact on the resulting part, even if they are chosen outside these criteria. Indeed, they represent a tiny fraction of the intermediate part, and generally less than 1% of it.

It can readily be understood that the intermediate part of the invention may have dimensions that are variable depending on the diameter of the ammunition for which it is designed. It may also be adapted to the quantity and to the gauge or "bore" of the shot. However, since the type of weapons concerned is smoothbore weapons used essentially for medium-size game or for clay pigeon shooting, for which the gauges or "bores" lie in the range 10 to 36, it is recommended to remain within certain proportions.

Thus, in accordance with a characteristic of the intermediate part of the present invention, the sleeve has a length lying in the range 35 mm to 45 mm, while the wad has a length lying in the range 3 mm to 20 mm. For example, a sleeve that has a length of 40 mm is recommended for 12-bore cartridges, with a wad having a length lying in the range 10 mm to 15 mm, depending on the shot that is chosen.

The intermediate part as defined above advantageously replaces a conventional wadding cup because it makes it possible not only not to generate any waste polluting the natural environment, but also to offer unrivaled shooting quality. Indeed, it has been shown that it is capable of enabling the energy induced by the pressure from the combustion gases generated by combustion of the powder to be transmitted effectively to the shot, by guaranteeing uniform thrust without any energy loss. It has also been shown that cartridges equipped with such an intermediate part can be stored without being damaged in any way under usual conditions, namely in their boxes, away from humidity and moisture.

The present invention also provides ammunition designed for shooting during competitive or recreational activities such as hunting of the shooting type, clay pigeon shooting, or other activities, using the above-described intermediate part. The invention thus further provides a cartridge for a gun having a smoothbore barrel, which cartridge comprises i) a case that is generally cylindrical in shape and that has its rear portion mounted in a base or "head" made of metal; ii) an explosive charge in contact with a primer; and iii) a set of projectiles in the form of shot, said cartridge further comprising an intermediate part of the invention that separates the explosive charge from the shot. As indicated above, such a cartridge may be of any of the usual gauges or "bores".

In accordance with a particularly advantageous characteristic of the invention, the cartridge includes an intermediate part as described that is made of materials suitable for being degraded or for decomposing at least to 95% by weight in the natural environment in less than 25 days. Preferably, the materials of the intermediate part are chosen in such a manner that the sleeve is degraded in less than 15 days and that the wad is decomposed into fragments of natural matter that is inoffensive for the environment, also in less than 15 days. The degradation is then almost complete (to 98% or more) after 25 days. Such materials are, for example, cardboard for making the sleeve and the dish (together with the rigid separator disk if one is used), and an agglomerate of cork or of woodchips for the wad. The fragments of cork or of wood, which are not toxic and that cannot be identified visually or at least not to any significant extent, are then degraded in their turn in a few months, by the action both of microorganisms and also of other living organisms, such as insects, rodents, etc.

The cartridge of the invention is thus a cartridge that has wadding and a cup, that is environmentally friendly, and that can be used for any type of shooting with smoothbore weapons, for competitive or recreational purposes, out in the natural environment, without contravening regulations prohibiting use of cartridges equipped with wadding skirts made of synthetic materials.

BRIEF DESCRIPTION OF THE DRAWINGS

The present invention can be better understood and details of it appear in the light of the following description of a particular embodiment, given with reference to the accompanying figures, in which.

DESCRIPTION OF THE PREFERRED EMBODIMENTS

Example 1

Intermediate Part

Figure 1:
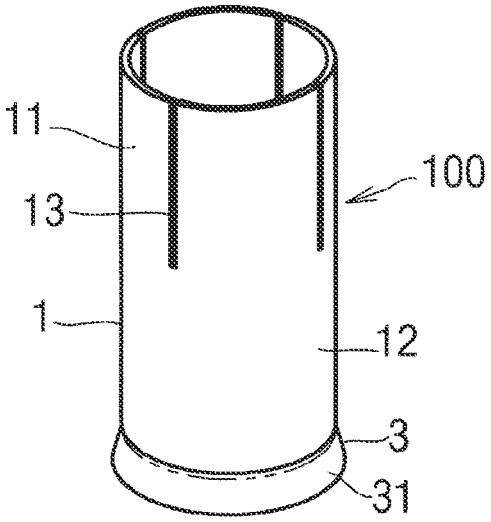
FIG. 1 is a perspective view of an intermediate part of the invention.
Figure 2:
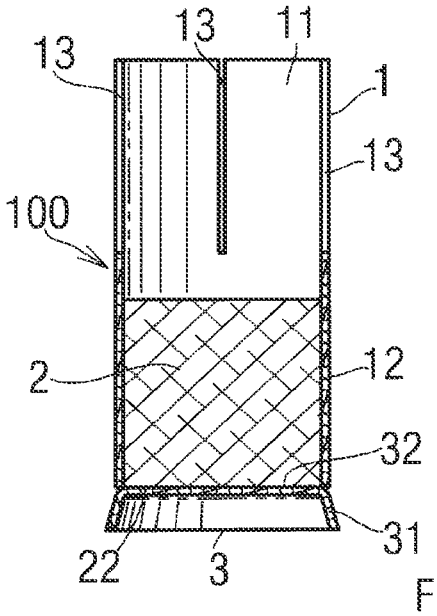
FIG. 2 is a section view of the same part.
Figure 3:
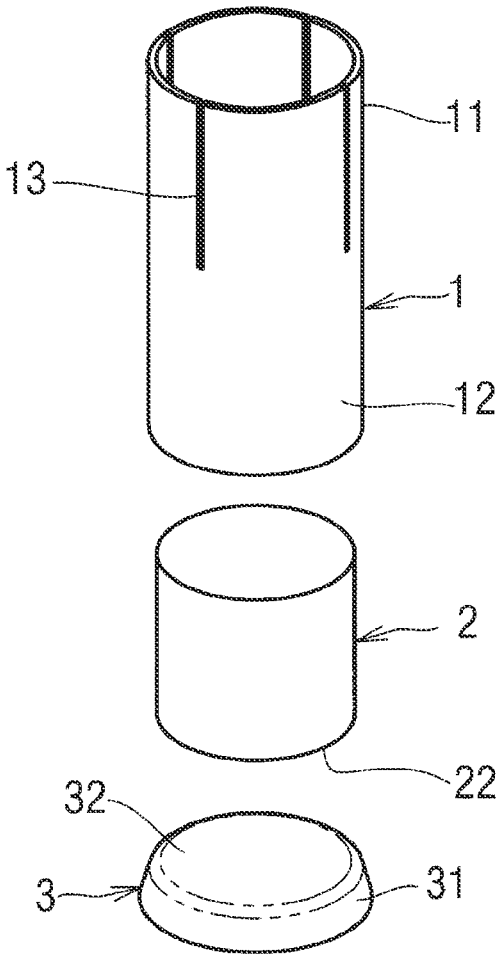
FIG. 3 is an exploded view of the various component elements of an intermediate part of the invention.

The intermediate part 100 as shown in FIGS. 1, 2, and 3 comprises a sleeve 1 and a wad 2 to which a dish 3 is fastened. The sleeve 1, which is of cylindrical section, is constituted by a cardboard tube comprising a front portion 11 that receives a metered quantity of shot, and a rear portion 12 in which the wad 2 is situated. For example, the tube may be made of spirally wound cardboard, which is available from cardboard manufacturers in various dimeters and in various grammages. The grammage is such that the thickness of the cardboard lies in the range 0.4 mm to 1 mm. Furthermore, the sleeve 1 has a diameter that is determined by the size of the cartridge into which the intermediate part is to be placed. For example, it is possible to use a tube that has an inside diameter of 17.4 mm, that is made of cardboard having a thickness of 0.6 mm (+/−0.1 mm), that thus has an outside diameter of 18.6 mm (+/−0.1 mm), and that is suitable for equipping a 12-gauge or "12-bore" cartridge. Four slits 13 that are equidistant and that are parallel to the axis of the sleeve 1 are provided in the front portion of the sleeve over a length of 18 mm, enabling the sleeve to peel open during firing, thereby splaying out to give shape to the spray of shot.

Cardboard is a material of choice for achieving the desired objectives. It is strong while also having a certain amount of elasticity, thereby preventing it from tearing during the thrust from the gases. Furthermore, it is hydrophilic, at least when it is not subjected to any particular treatment, so that it absorbs any ambient humidity or moisture of any origin: puddles, rain showers, fog, and morning dew. As a result, it is digested rapidly by the microorganisms that develop on the cellulose of natural sites. The cardboard sleeve is thus 100% biodegradable and it disappears totally about three weeks after being fired, or even earlier if conditions are favorable, when it is left in a meadow or in a wood.

The wad 2 is in the form of a solid cylinder occupying the rear portion 12 of the sleeve 1. The rear face 22 of the wad 2 is flush with the end of the sleeve 1, i.e. the rear face 22 of the wad 2 and the end of the sleeve 1 lie in the same plane, which is orthogonal to the axis of the sleeve 1. Its diameter is identical to the diameter of the sleeve 1, so that it is held by friction forces on being inserted by being pressed into the sleeve 1. In the present example, its diameter is 17.4 mm, like the inside diameter of the sleeve for a 12-bore, and its height is chosen to lie in the range 10 mm to 15 mm (adjusted as a function of the shot charge or shot load).

The wad 2 is made up of ground cork granules (the size of the granules lying in the range 0.5 mm to 2 mm) amalgamated by means of a thermoplastic resin, added at a content by mass of in the range 0.5% to 0.8%. It is advantageous to use cork because it plays its part as a damper or shock absorber very effectively. It is also completely natural and without any toxicity either for fauna or for flora. The biodegradable binder is digested by the microorganisms in a few days, thereby releasing fragments of cork that disperse without causing any harm into the environment, so that they are then used and/or degraded gradually by the living organisms, as would be any woody debris.

Figure 5:
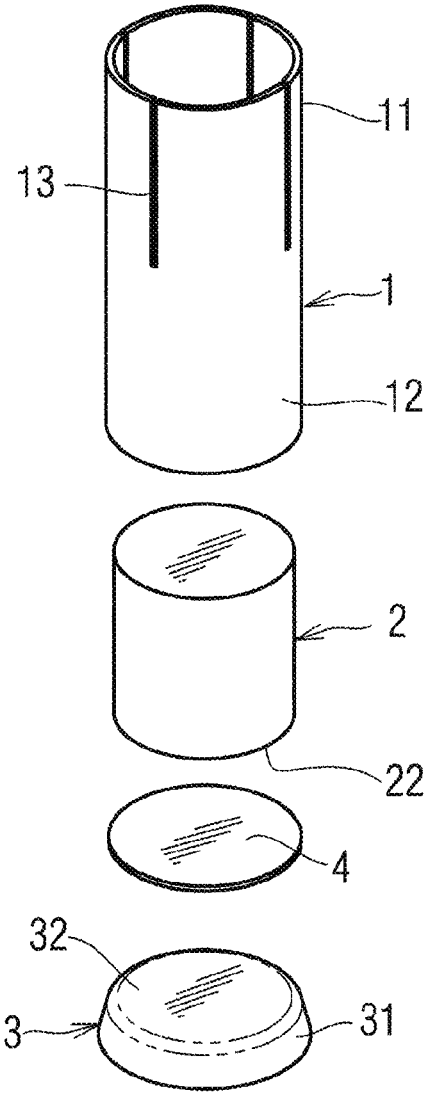
FIG. 5 is an exploded view of the various component elements of an intermediate part of another embodiment of the invention.
Figure 6:
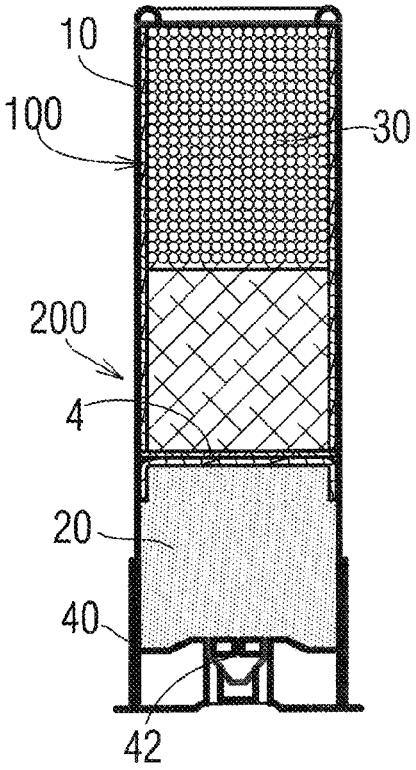
FIG. 6 is a section view of a cartridge equipped with an intermediate part of another embodiment of the invention.

A cardboard wafer that has a thickness of 0.5 mm was stamped to obtain a dish 3 having an end wall 32 that had a diameter identical to the diameter of the wad 2 (17.4 mm in this embodiment) with a circular rim 31 of 3 mm. The outer face of the end wall 32 was pasted with a cellulose adhesive and fastened to the wad 2 at the end of the intermediate part. In a particular embodiment, a rigid disk 4 (see FIGS. 5-6) (not shown) that is of diameter identical to the diameter of the sleeve 1, and that is made of the same cardboard may be bonded adhesively to the wad 2 beforehand.

Just like the sleeve 1, the dish 3 is digested rapidly by the microorganisms of natural sites, as is the rigid disk. The dish 3 is thus 100% biodegradable and disappears completely a few weeks after being fired.

Example 2

Cartridge

Figure 4:
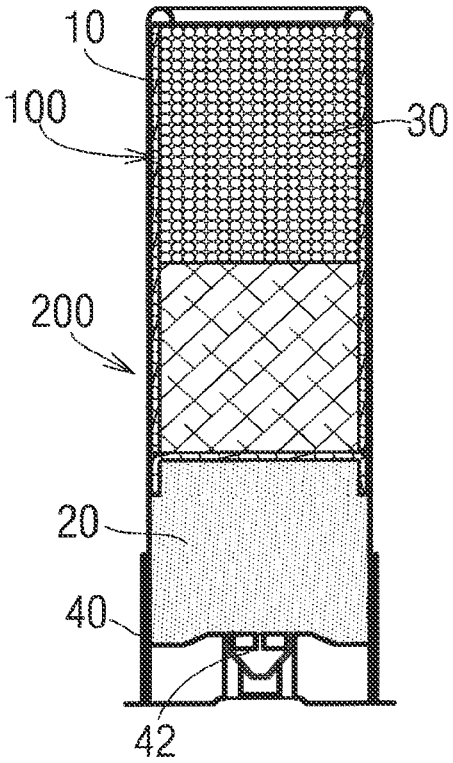
FIG. 4 is a section view of a cartridge equipped with an intermediate part of the invention.

The cartridge 200 shown in FIG. 4 includes an intermediate part 100 as described above. In conventional manner, the cartridge 200 is formed of the case 10, which is cylindrical and made of a plastics material of a type known per se. Its rear portion is mounted in the base or "head" 40 that is made of metal, e.g. of brass. The cartridge 200 contains the powder constituting the explosive charge 20 that is in contact with the primer 42. The shot 30 is received in the front portion 11 of the intermediate part 100, so that it is separated from the explosive charge 20. The explosive charge is confined to its compartment by means of the dish 3, the rim 31 of which provides sealing.

In particularly advantageous manner, the case of the cartridge may be transparent, or at least translucent, in such a manner as to allow the sleeve it contains, and in particular the indications printed on said sleeve, to show through it. Specifically, while the cartridge 200 is being manufactured, it is possible to print information for users on the sleeve 1, such as the gauge or bore, the length of the case, or the brand of the manufacturer. Printing on cardboard is easy and remains visible lastingly, whereas the marking commonly performed on the case tends to fade away, which can cause accidents. Such marking is conducive to improving user safety, and without going as far as that, will be appreciated by users because it is practical.

Example 3

Ballistic Tests

The intermediate part in example 1 was tested with 12-bore cartridges. About one hundred shots were fired at a target, and they were compared with shots fired under the same conditions with cartridges equipped with conventional models of wadding skirts. The results obtained were very satisfactory. No loss of pressure was observed during firing, nor were any disturbances in the spray of shot. The performance in terms of grouping of the impacts was excellent, denoting a uniform structural shaping of the cartridge and of the intermediate part. Comparatively, the ballistic qualities were better than those obtained with wadding having skirts made of plastic.

Thus, a cartridge is provided that has wadding and a cup, that is environmentally friendly, and that has performance appreciated by hunters or shooters.

The invention claimed is:

1. An intermediate part for placement in a case (10) of a cartridge (200) to separate an explosive charge (20) from shot (30), said intermediate part comprising:

a cylindrical sleeve (1) having an outside diameter adapted to being slidably inserted into the case (10) of the cartridge (200), said sleeve formed as a tube with a front portion (11) for containing said shot, an open end, and a rear portion (12) that contains a cylindrical wad (2) that closes off said rear portion completely, the cylindrical wad having a rear face (22) that is flush with an end of the rear portion (12) of the sleeve (1), at least 95% by weight of said intermediate part being constituted by biodegradable or decomposable materials.

2. The intermediate part according to claim 1, wherein at least 95% by weight of the sleeve (1) is formed by biodegradable materials.

3. The intermediate part according to claim 2, wherein the sleeve (1) is constituted by a cardboard tube of a thickness in a range of 0.4 mm to 1 mm.

4. The intermediate part according to claim 2, wherein at least 95% of the wad (2) is formed by biodegradable materials, by decomposable natural materials, or by a combination of both types of material.

5. The intermediate part according to claim 1, wherein the sleeve (1) is constituted by a cardboard tube of a thickness in a range of 0.4 mm to 1 mm.

6. The intermediate part according to claim 5, wherein at least 95% of the wad (2) is formed by biodegradable materials, by decomposable natural materials, or by a combination of both types of material.

7. The intermediate part according to claim 1, wherein at least 95% of the wad (2) is formed by biodegradable materials, by decomposable natural materials, or by a combination of both types of material.

8. The intermediate part according to claim 1, wherein the wad (2) comprises one or more materials chosen from the group consisting of: cork, cardboard, paper, wood fiber, and felt.

9. The intermediate part according to claim 8, wherein the wad (2) is formed in one piece of a single material, or it is formed of superposed slices of a same material or of different materials.

10. The intermediate part according to claim 8, wherein the wad (2) is formed of fragments of one or more materials that are amalgamated by a binder representing less than 1% of the total mass.

11. The intermediate part according to claim 1, wherein the wad (2) is held in place in the sleeve (1) by friction, or by friction and adhesive bonding.

12. The intermediate part according to claim 1, wherein the rear face (22) of the wad (2) is associated with a dish (3) made of a biodegradable material and having an end-wall (32) of diameter identical to the diameter of the sleeve (1) and a circular rim (31) that extends rearwards in alignment with said sleeve.

13. The intermediate part according to claim 12, wherein an assembly associating the dish (3) and the rear face (22) of the wad (2) comprises a rigid separator disk (4) having a periphery bearing against the end of the rear portion (12) of the sleeve (1).

14. The intermediate part according to claim 13, wherein the dish (3) and the separator disk are made of cardboard having a thickness ranging from 0.3 mm to 1 mm, and are fastened to the rear face (22) of the wad (2) by adhesive bonding.

15. The intermediate part according to claim 1, wherein the sleeve (1) is provided with slits (13) that are equidistant and that extend longitudinally from the front end (11) towards the rear portion (12) of said sleeve, said slits being cut fully or being in the form of partial pre-cuts.

16. The intermediate part according to claim 1, wherein at least 99% by weight of said intermediate part is constituted by biodegradable or decomposable materials.

17. The intermediate part according to claim 1, wherein the sleeve (1) has a length in a range of 35 mm to 45 mm, and the wad (2) has a length in a range of 3 mm to 20 mm.

18. The intermediate part according to claim 1, wherein the sleeve (1) has a length in a range of 35 mm to 45 mm, and the wad (2) has a length in a range of 3 mm to 20 mm.

19. A cartridge (200) for a gun having a smoothbore barrel, wherein said cartridge comprises a case (10) that is cylindrical in shape, the case having a rear portion mounted in a base (40) made of metal, an explosive charge (20) in contact with a primer (42), and a set of projectiles in the form of shot (30), said cartridge further comprising an intermediate part (100) according to claim 1 that separates the explosive charge (20) from the shot (30).

20. The cartridge according to claim 19, wherein said intermediate part (100) is made of materials suitable for being degraded or for decomposing at least to 95% by weight in the natural environment in less than 25 days.

* * * * *